United States Patent [19]

Toku

[11] Patent Number: 4,580,785

[45] Date of Patent: Apr. 8, 1986

[54] GOLF CLUB

[76] Inventor: Masateru Toku, Hatagaya 3-10-3, Shibuya-ku, Tokyo, Japan

[21] Appl. No.: 676,931

[22] Filed: Nov. 30, 1984

[30] Foreign Application Priority Data

Nov. 30, 1983 [JP] Japan ..... 58-224500

[51] Int. Cl.[4] ..... A63B 69/36

[52] U.S. Cl. ..... 273/186 A; 273/80 C; 273/80 B

[58] Field of Search ..... 273/80 B, 186 A, 80 R, 273/80 A, 80 C, 80 D, 80.1, 80.2, 80.9, 80.8, 193 R, 193 B, 194 R

[56] References Cited

U.S. PATENT DOCUMENTS 1,131,486 3/1915 Dixon ..... 273/80 B 3,612,121 10/1971 Estwing ..... 273/80 B X

*Primary Examiner*—George J. Marlo

*Attorney, Agent, or Firm*—Eidelman, Wolffe & Waldron

[57] ABSTRACT

A golf club is provided which will enable a golf player to easily determine when he has executed an improper swing known as a "twist swing". The golf club of the present invention is characterized by a hollow, circular readily flexible shaft provided with a conventional wood or metal club head at one end and a grip at the other end with a flexible, thin, flat metal leaf or strip fixedly positioned within the hollow shaft for substantially its entire length with the width thereof corresponding to the internal diameter of the shaft. The metal leaf is placed in an alignment with the shaft such that when a "twist swing" is created the metal leaf will be torsionally twisted along its longitudinal axis and will create a rubbing sound and cause vibration to the shaft.

3 Claims, 12 Drawing Figures

GOLF CLUB'

BACKGROUND OF THE INVENTION

This invention relates to a golf club, and more particularly to an improvement of a golf club which is suitable for practice.

A wood or iron golf club is a slender tubular shaft with a grip at the upper end thereof and a heavy head at the lower end thereof. This structure tends to induce what is called a "twist swing". This "twist swing" which makes it impossible to drive a ball straight to the target, requires a training for correction but it is very difficult for the golf player or swinger himself to distinguish a "twist swing" from a swing when he strikes a golf ball.

SUMMARY OF THE INVENTION

Accordingly it is an object of the invention to solve the above problem and to provide a golf club for practice which enables a player himself to easily distinguish a good swing from a bad one during the act of swinging.

A golf club according to the invention, namely a shaft which has a grip at the upper end thereof and a head at the lower end thereof, is composed of a material which is flexible in any direction in correspondence with a swing, and a metal leaf which is easy to twist and which has a width sufficient to keep the two sides of its both ends in contact with the inner surface of the shaft at diametrically opposing points of the inner surface, the metal leaf being fixed at both ends of the shaft at an angular position such that the metal leaf is parallel to the hitting face of the head.

BRIEF DESCRIPTION OF THE DRAWINGS

This and other objects as well as advantages of the present invention will become clear by the following description of a preferred embodiment of the present invention with reference to the accompanying drawings, wherein.

Figure 6:
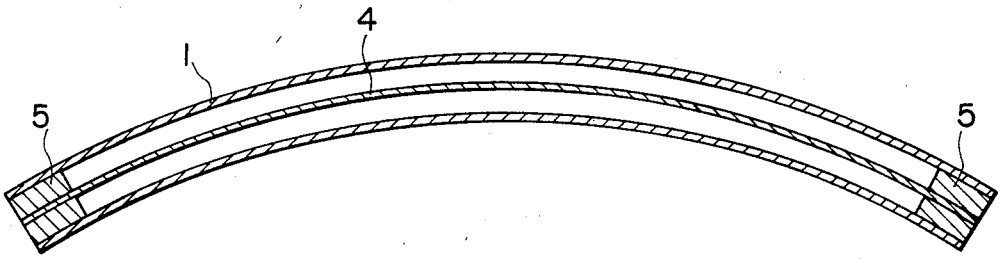
Figure 8:
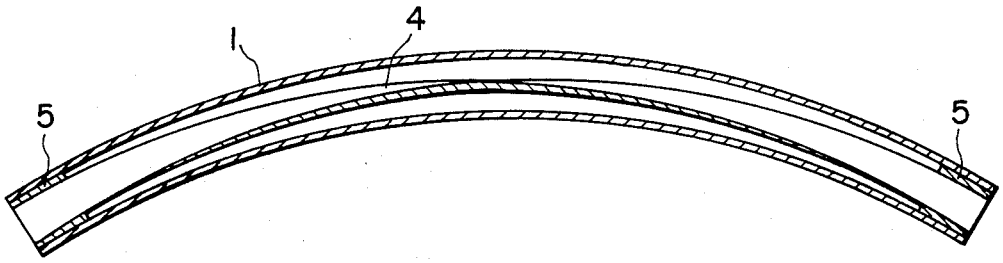

FIGS. *5a, 5b, 5c* show the angular positions of the metal leaf and the hitting face of the head at the time of a good swing;

FIG. 6 is a sectional view of the shaft at the time of a good swing;

FIGS. *7a, 7b, 7c* show the angular positions of the metal leaf and the face of the head at the time of a twist swing; and FIG. 8 is a sectional view of the shaft at the time of a twist swing.

DETAILED DESCRIPTION OF THE PREFERRED EMBODIMENT

Hereinafter, this invention will be described in detail with reference to the accompanying drawings which show an embodiment of the invention.

Referring to FIGS. 1 to 4, the referential numeral 1 represents a hollow shaft, 2 a grip and 3 a wood head. The shaft 1 is composed of synthetic resin mixed with glass fiber such as to be flexible in any direction and inside the shaft 1 a thin steel or metal leaf 4 which has a width sufficient when the leaf is inserted within the shaft will span the internal diameter of the shaft and which is easy to twist is fixed at both ends of the shaft through a retaining member 5 at an angular position such that the metal leaf is parallel to the hitting face *3a* of the head 3.

In a golf club which has the above structure, the metal leaf 4 in the shaft 1 twists at the time of an unfavorable "twist swing", and slides in contact with the inner surfaces of the shaft producing a sliding noise and vibration. The vibration is transmitted to the player through the hands on the grip 2, whereby the player can easily judge such "twist swing" when it occurs.

Figure 1:
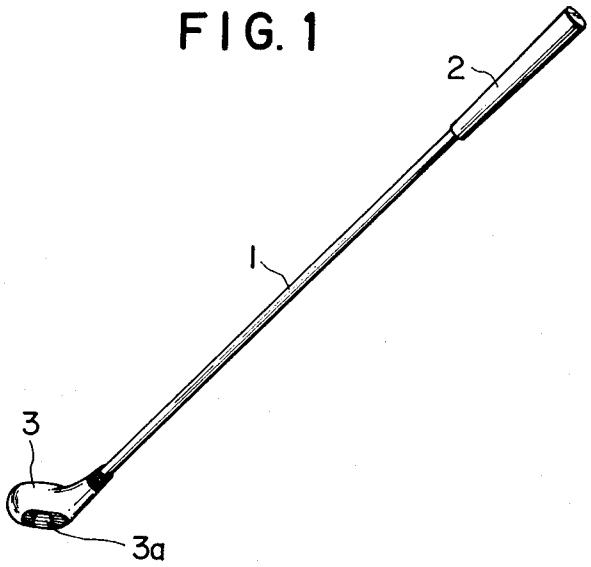
FIG. 1 is a perspective view of a golf club according to the invention.
Figure 2:
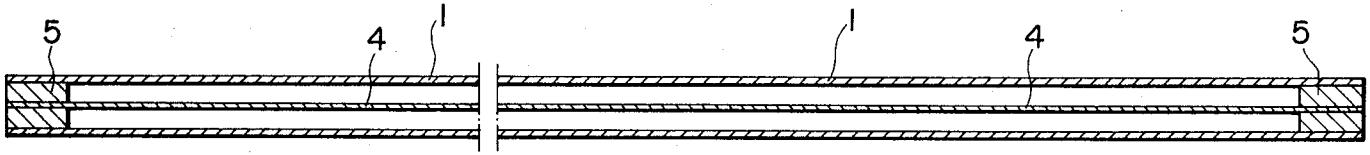
FIG. 2 is an enlarged vertical sectional view of the shaft of the golf club shown in FIG. 1.
Figure 3:
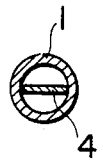
FIG. 3 is a partially sectional view of FIG. 2.
Figure 4:
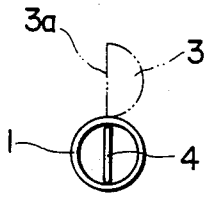
FIG. 4 shows the angular relationship as between a metal leaf in the shaft and the hitting face of the head.
Figure 5:
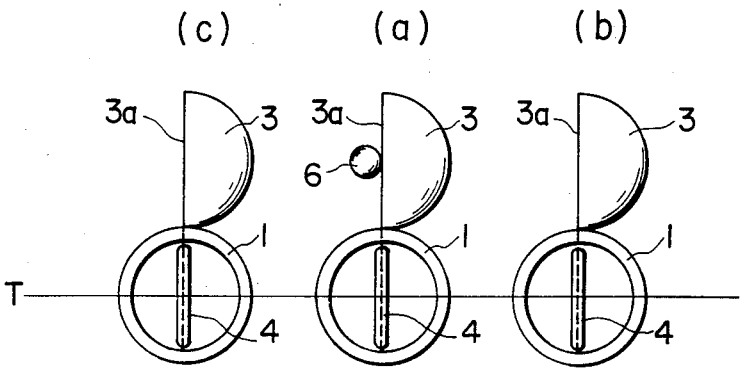

In other words, as is shown in FIG. 5, when the club is swung describing a swing trail T, starting from address (a) and leading to take-back (b), impact (a), and follow-through (c), if the metal leaf 4 in the shaft 1 is kept parallel to the face *3a* of the head, the metal leaf 4 does not twist in relation to the shaft 1, as is shown in FIG. 6, and therefore no sliding noise is produced. The golf ball is denoted by numeral 6.

Figure 7:
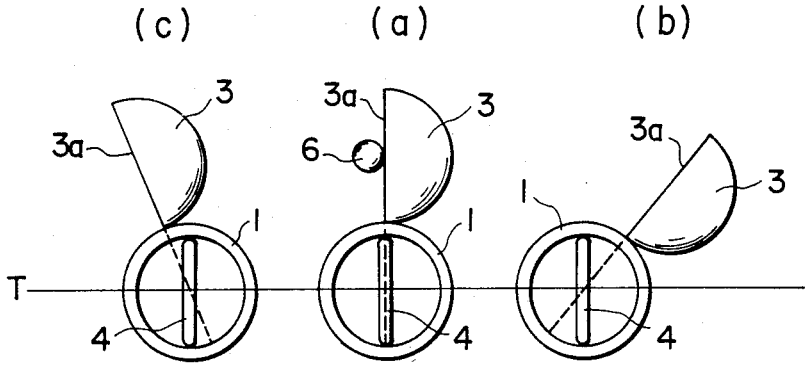

On the other hand, as is shown in FIG. 7, when the club is swung describing a swing trail T, and the metal leaf 4 is not in parallel to the hitting face *3a* of the head 3, the metal leaf 4 twists as shown in FIG. 8 and both the longitudinal edges slide in contact with the inner surfaces of the shaft so that a sliding noise is produced, which identifies a "twist swing". In this case, the direction in which the metal leaf 4 twists during a downswing is opposite to that during a follow-through (c) as shown in FIG. 7.

As described above, according to this invention, the shaft of the club is composed of a material which is flexible in any direction, and a metal leaf which is easy to twist and which has a width sufficient to keep the two sides of its both ends in contact with the inner surface of the shaft at diametrically opposing points of the inner surface, is fixed at both ends of the shaft at a position such that the metal leaf is parallel to the hitting face of the head. In other words, this invention provides a golf club which enables a player himself to easily distinguish a "twist swing" from a good or unfavorable swing during the act of swinging.

Accordingly, practice with a golf club according to the invention can heighten the chances of correcting a "twist swing".

While there has been described what is at present considered to be a preferred embodiment of the invention, it will be understood that various modifications may be made therein, and it is intended that the appended claims cover all such modifications as fall within the true spirit and scope of the invention.

As mentioned above, when the club is incorrectly swung out of the proper trail, a sliding noise which can be heard by the golf swinger is produced. Conversely speaking, when a golfer uses a golf club according to the present invention and is mindful of a proper swing, no sliding noise is produced and a struck golf ball will be driven correctly and straight to the target.

And also, under the good swing of the golf club according to the present invention, it is promisable that a driving distance of the ball will be increased a large margin by the flexibility, elasticity and force of the shaft including the metal leaf and club head of the club. It is needless to say, therefore, that the golf club according to the present invention can be used not only for practice or training but also for a game as a usual golf club in a golf course after the thorough handling of such golf club.

What is claimed is:

1. A golf club for determining the existence of a "twist swing" when used comprising a hollow, circular shaft made of a material which provides flexibility to said shaft in any direction, a golf club head having a striking face secured in operating relationship to one end of said shaft, a grip secured to the opposite end of said shaft in encircling relationship therearound, an elongated thin, flat metal leaf inserted within said shaft, said leaf having a high degree of flexibility along its longitudinal axis and a width corresponding substantially to the internal diameter of said shaft with the side edges of the metal leaf engaging the internal surface of the shaft at diametrically opposite points and being of a length corresponding generally to the length of said shaft, and securing means mounted within the opposite ends of said shaft to secure each end of said metal leaf within said shaft, said metal leaf when positioned with said shaft having its wide sides in substantially longitudinal alignment with the striking face of said club head whereby upon the creating of a "twist swing" by a user of the golf club, said metal leaf will have a torsional twist created along its longitudinal axis causing the metal leaf to engage the inner wall surface of said shaft thereby creating a sliding noise and imparting vibration to said shaft.

2. A golf club in accordance with claim 1 wherein said shaft is composed of synthetic resin mixed with fiberglass to form a conventional fiberglass shaft.

3. A golf club in accordance with claim 2 wherein said head is wood.

* * * * *